US010309199B2

(12) United States Patent
Eitschberger

(10) Patent No.: US 10,309,199 B2
(45) Date of Patent: Jun. 4, 2019

(54) INITIATOR HEAD ASSEMBLY

(71) Applicant: DynaEnergetics GmbH & Co. KG, Troisdorf (DE)

(72) Inventor: Christian Eitschberger, München (DE)

(73) Assignee: DynaEnergetics GmbH & Co. KG, Troisdorf (DE)

( * ) Notice: Subject to any disclaimer, the term of this patent is extended or adjusted under 35 U.S.C. 154(b) by 0 days.

(21) Appl. No.: 15/788,367

(22) Filed: Oct. 19, 2017

(65) Prior Publication Data

US 2018/0038208 A1 Feb. 8, 2018

Related U.S. Application Data

(63) Continuation of application No. 15/331,954, filed as application No. PCT/EP2015/059381 on Apr. 29, 2015, now Pat. No. 9,822,618.

(Continued)

(51) Int. Cl.

| | |
|---|---|
| ***E21B 43/1185*** | (2006.01) |
| ***F42C 19/06*** | (2006.01) |
| ***F42B 3/26*** | (2006.01) |
| ***F42D 1/04*** | (2006.01) |
| ***F42D 1/045*** | (2006.01) |
| ***F42B 3/103*** | (2006.01) |

(52) U.S. Cl.

CPC ..... *E21B 43/1185* (2013.01); *F42B 3/103* (2013.01); *F42B 3/26* (2013.01); *F42C 19/06* (2013.01); *F42D 1/041* (2013.01); *F42D 1/043* (2013.01); *F42D 1/045* (2013.01)

(58) Field of Classification Search

CPC ..... E21B 43/1185; F42B 3/103; F42B 3/26; F42C 19/06; F42D 1/041; F42D 1/043; F42D 1/045

USPC ..... 102/202.5, 202.9, 275.11

See application file for complete search history.

(56) References Cited

U.S. PATENT DOCUMENTS

| | | | | |
|---|---|---|---|---|
| 2,228,873 A * | 1/1941 | English | F42B 3/103 | 102/202.14 |
| 4,107,453 A * | 8/1978 | Erixon | H01R 4/10 | 102/202.5 |

(Continued)

FOREIGN PATENT DOCUMENTS

| | | |
|---|---|---|
| CA | 2821506 A1 | 1/2015 |
| DE | 102007007498 A1 | 8/2008 |
| WO | WO-2015028204 A2 | 3/2015 |

OTHER PUBLICATIONS

International Search Report and Written Opinion of International Application No. PCT/EP2015/059381, dated Nov. 23, 2015, 14 pages.

(Continued)

*Primary Examiner* — Samir Abdosh
(74) *Attorney, Agent, or Firm* — Moyles IP, LLC

(57) ABSTRACT

An initiator head assembly having particular application with a perforating gun assembly. The initiator head assembly includes a body and an electrical contact component with the electrical contact component embedded therein. The initiator head assembly with the embedded electrical contact component is configured as a unitary component, and holds a pressure differential across the top and bottom parts of the initiator head assembly. A method of forming the initiator head assembly is also generally described.

19 Claims, 8 Drawing Sheets

Related U.S. Application Data

(60) Provisional application No. 62/050,678, filed on Sep. 15, 2014, provisional application No. 61/988,722, filed on May 5, 2014.

(56) References Cited

U.S. PATENT DOCUMENTS

| | | | |
|---|---|---|---|
| 4,574,892 | A | 3/1986 | Grigar et al. |
| 5,105,742 | A | 4/1992 | Sumner |
| 7,762,172 | B2 | 7/2010 | Li et al. |
| 7,778,006 | B2 | 8/2010 | Stewart et al. |
| 8,157,022 | B2 | 4/2012 | Bertoja et al. |
| 8,256,337 | B2 | 9/2012 | Hill et al. |
| 8,875,787 | B2 | 11/2014 | Tassaroli |
| 9,689,223 | B2 | 6/2017 | Schacherer et al. |
| 2003/0001753 | A1 | 1/2003 | Cernocky et al. |
| 2004/0141279 | A1 | 7/2004 | Amano et al. |
| 2007/0158071 | A1 | 7/2007 | Mooney, Jr. et al. |
| 2008/0149338 | A1 | 6/2008 | Goodman et al. |
| 2012/0094553 | A1 | 4/2012 | Fujiwara et al. |
| 2014/0033939 | A1* | 2/2014 | Priess ..... F42B 3/103 102/333 |
| 2016/0273902 | A1 | 9/2016 | Eitschberger |

OTHER PUBLICATIONS

Dynaenergetics, Electronic Top Fire Detonator, Product Information Sheet, Jul. 30, 2013, 1 page.

Hunting Titan, Wireline Top Fire Detonator Systems, http://www.hunting-intl.com/titan/perforating-guns-and-setting-tools/wireline-top-fire-detonator-system, 1 page.

Dynaenergetics, DYNAselect System, Jul. 3, 2013, http://www.dynaenergetics.com/, 2 pages.

Jim Gilliat/Khaled Gasmi, New Select-Fire System, Baker Hughes, Apr. 29, 2013, http://www.perforators.org/presentations.php, 16 pages.

* cited by examiner

INITIATOR HEAD ASSEMBLY

CROSS-REFERENCE TO RELATED APPLICATIONS

This application is a continuation of U.S. application Ser. No. 15/331,954 filed Oct. 24, 2016, which claims priority to PCT Application No. PCT/EP2015/0059381 filed Apr. 29, 2015, which claims the benefit of U.S. Provisional Application No. 61/988,722, filed May 5, 2014, and U.S. Provisional Application No. 62/050,678, filed Sep. 15, 2014, all of which are incorporated herein by reference in their entireties.

FIELD

Described generally herein is an initiator head assembly having an embedded electric feed-through for use with a perforating gun assembly, in particular for oil well drilling applications.

BACKGROUND

In exploration and extraction of hydrocarbons, such as fossil fuels (e.g. oil) and natural gas, from underground wellbores extending deeply below the surface, various downhole tools are inserted below the ground surface and include sometimes complex machinery and explosive devices. Examples of the types of equipment useful in exploration and extraction, in particular for oil well drilling applications, include logging tools and perforation gun systems and assemblies. It is often useful to be able to maintain a pressure across one or more components as necessary to ensure that fluid does not leak into the gun assembly, for instance. It is not uncommon that components such as an initiator are components in such perforating gun assemblies that succumb to pressure leakage. It is particularly useful that one or more of the components is able to maintain a pressure differential even after, for instance, detonation of one or more downstream components.

The initiator is one of many components of the perforating gun system for which continual improvement is sought. There are at least 2 known types of initiators—a detonator and an igniter.

Upon placement into the perforating gun assembly, one or more initiators have traditionally required physical connection of electrical wires. The electrical wires typically travel from the surface down to the perforating gun assembly, and are responsible for passing along the surface signal required to initiate ignition. The surface signal typically travels from the surface along the electrical wires that run from the surface to one or more detonators positioned within the perforating gun assembly. Such initiators typically require electronic componentry and/or wiring to pass through a body thereof, (e.g. electric feed-through), and a need exists to provide such componentry having electric feed-through while maintaining a differential pressure across the component. Passage of such wires through the initiator, while maintaining a pressure differential across the component, has proved challenging.

Assembly of a perforating gun requires assembly of multiple parts, which typically include at least the following components: a housing or outer gun barrel within which is positioned an electrical wire for communicating from the surface to initiate ignition, an initiator, a detonating cord, one or more charges which are held in an inner tube, strip or carrying device and, where necessary, one or more boosters.

Assembly typically includes threaded insertion of one component into another by screwing or twisting the components into place, optionally by use of a tandem adapter. Since the electrical wire must extend through much of the perforating gun assembly, it is easily twisted and crimped during assembly. In addition, when a wired detonator is used it must be manually connected to the electrical wire, which has lead to multiple problems. Due to the rotating assembly of parts, the wires can become torn, twisted and/or crimped/nicked, the wires may be inadvertently disconnected, or even misconnected in error during assembly, not to mention the safety issues associated with physically and manually wiring live explosives.

According to the prior art and as shown in FIG. 1, a wired detonator 60 has been configured such that wires must be physically, manually connected upon configuration of the perforating gun assembly. As shown herein, the wired detonator 60 typically has two (or more) wires, which require manual, physical connection once the wired detonator is placed into the perforating gun assembly. (It is possible to have one or more wires whereby one wire could also be a contact as described in greater detail below and as found, for instance, in a spring-contact detonator, commercially available from DynaEnergetics GmbH & Co. KG without the benefit of selectivity and whereby a second connection would be through a shell or head of the detonator.) For detonators with a wired integrated switch for selective perforating, the wires include at least a signal-in wire 61, a signal-out wire 62 and a ground wire 63, while it is possible that only two wires are provided and the third or ground connection is made by connecting the third wire to the shell or head of the detonator. In a typical manual, physical connection, the wires extending along the perforating gun are matched to the wires of the detonator, and an inner metallic portion of one wire is twisted together with an inner metallic portion of the matched wire using an electrical connector cap or wire nut or a scotch-lock type connector. Although not shown, maintenance of the pressure differential across such devices has occurred (minimally) via usage of rubber components including o-rings, rubber stoppers and the like.

Improvements to the way these electrical connections are accomplished include connections and arrangements as found in commonly assigned patent applications PCT/EP2012/056609 (in which an initiator head is adapted to easily introduce external wires into the plug without having to strip the wires of insulation beforehand) and DE 10 2013 109 227.6 (in which a wireless initiator is provided), which are incorporated herein by reference in their entirety.

The assembly described herein further solves the problems associated with prior known assemblies in that it provides, in an embodiment, an assembly to improve manufacturing costs and assembly in the field, as described in greater detail hereinbelow.

BRIEF DESCRIPTION

In an embodiment, an initiator head assembly includes a body and an electrical contact component extending through the body and embedded in the body, such that the body seals around the electrical contact component against pressure leakage across the body to maintain a higher pressure at a first end of the body as compared to a second end of the body, when the body is positioned within the downhole tool.

In an embodiment, at least the body has been formed as a unitary component.

In an aspect, a method of forming the initiator head assembly is provided.

BRIEF DESCRIPTION OF THE FIGURES

A more particular description briefly described above will be rendered by reference to specific embodiments thereof that are illustrated in the appended drawings. Understanding that these drawings depict only typical embodiments and are not therefore to be considered to be limiting of its scope, exemplary embodiments will be described and explained with additional specificity and detail through the use of the accompanying drawings in which.

Various features, aspects, and advantages of the embodiments will become more apparent from the following detailed description, along with the accompanying figures in which like numerals represent like components throughout the figures and text. The various described features are not necessarily drawn to scale, but are drawn to emphasize specific features relevant to embodiments.

DETAILED DESCRIPTION

Reference will now be made in detail to various embodiments. Each example is provided by way of explanation, and is not meant as a limitation and does not constitute a definition of all possible embodiments.

In an embodiment, the assembly provides an improved apparatus for use with a wireless connection—that is, without the need to attach, crimp, cut or otherwise physically and manually connect external wires to the component. Rather, the connections are made wirelessly, by simply abutting, for instance, electrically contactable components, of which at least a portion thereof is positioned proximal to an external surface of the pressure barrier. As used herein, the term "proximal" means on or near or next to or nearest or even embedded within. For the sake of clarity, the term "wireless" does not refer to a WiFi connection, but rather to this notion of being able to transmit electrical signals through the electrical componentry without connecting external wires to the component. The apparatus described herein solves the problems associated with the prior known assemblies in that it provides an assembly including the wireless connection integrated therein, to improve manufacturing costs and assembly in the field.

Figure 10:
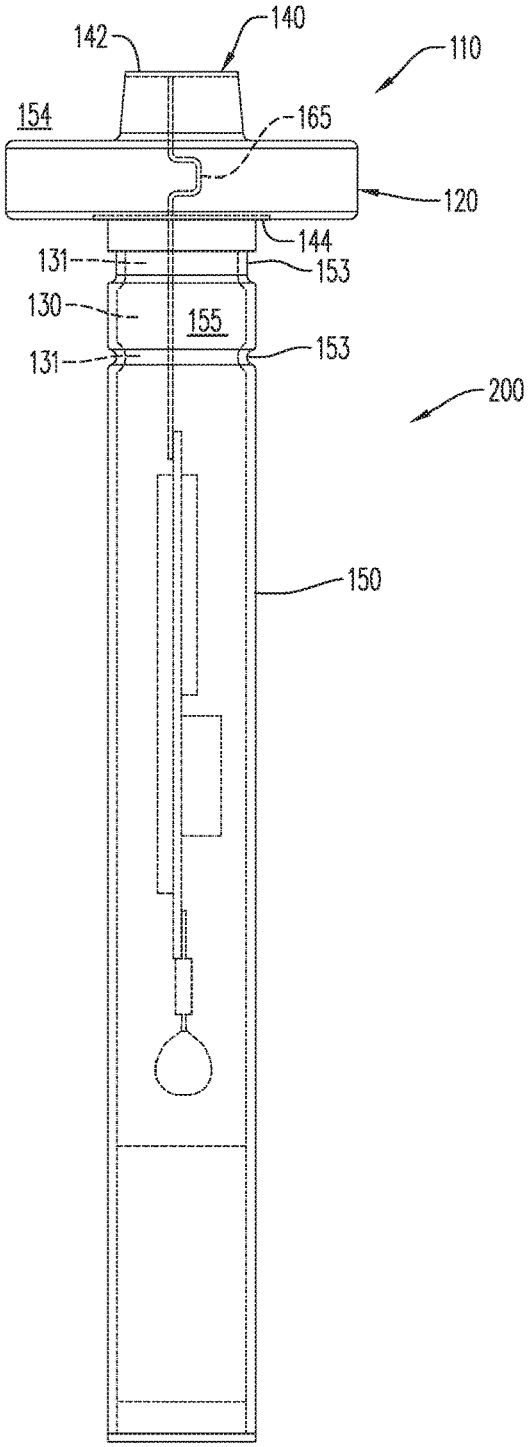
FIG. 10 is a cross-sectional side view of the initiator head assembly of FIG. 5 assembled with a shell to form the initiator according to an aspect shown in phantom.
Figure 11:
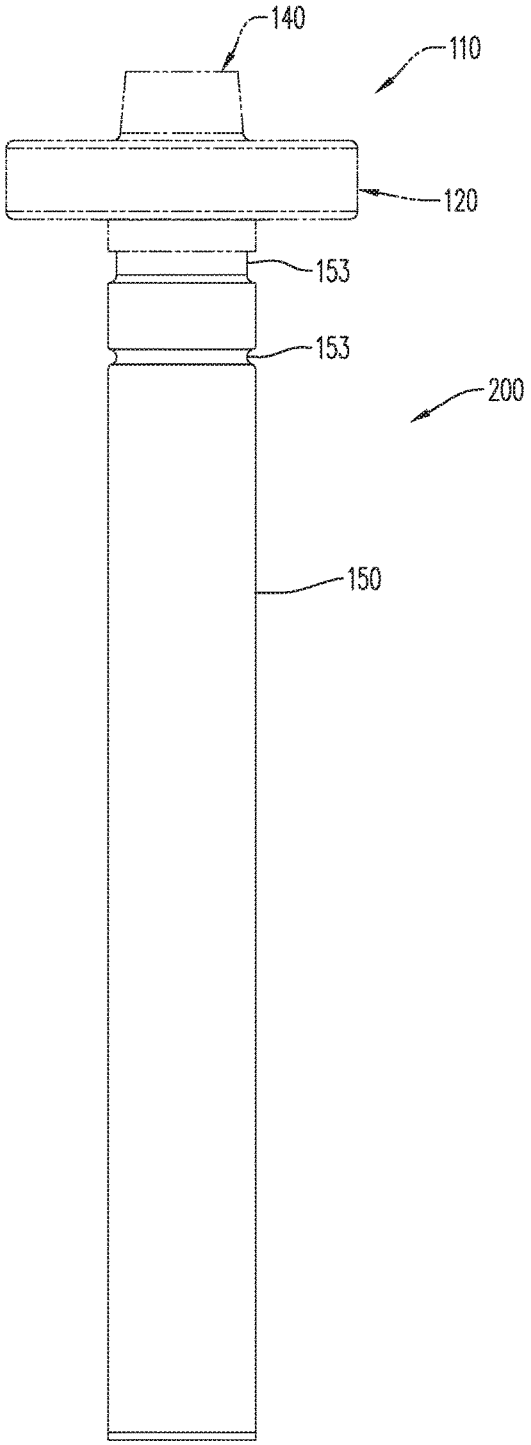
FIG. 11 is a side view of the initiator of FIG. 10 showing portions of the initiator head assembly in phantom.

In an embodiment, an assembly is provided that is capable of being placed into a perforating gun assembly or other downhole tool such as a setting tool with minimal effort. Specifically, an initiator head assembly 10, as found in FIGS. 2-4, or alternatively the initiator head assembly 110 as found in FIGS. 5-9, is positioned within an initiator 100, 200 (FIG. 4, configured as a detonator, and FIGS. 10-11, configured as an igniter, respectively) for use in the perforating gun assembly and to electrically contactably form an electrical connection without the need of manually and physically connecting, cutting or crimping wires as required in a wired electrical connection. In an embodiment, the initiator head assembly 10, 110 is a wirelessly-connectable selective assembly using a unitary member, as will be discussed in greater detail below. By "unitary" what is meant is that the component is formed as a single, one-piece member.

Figure 2:
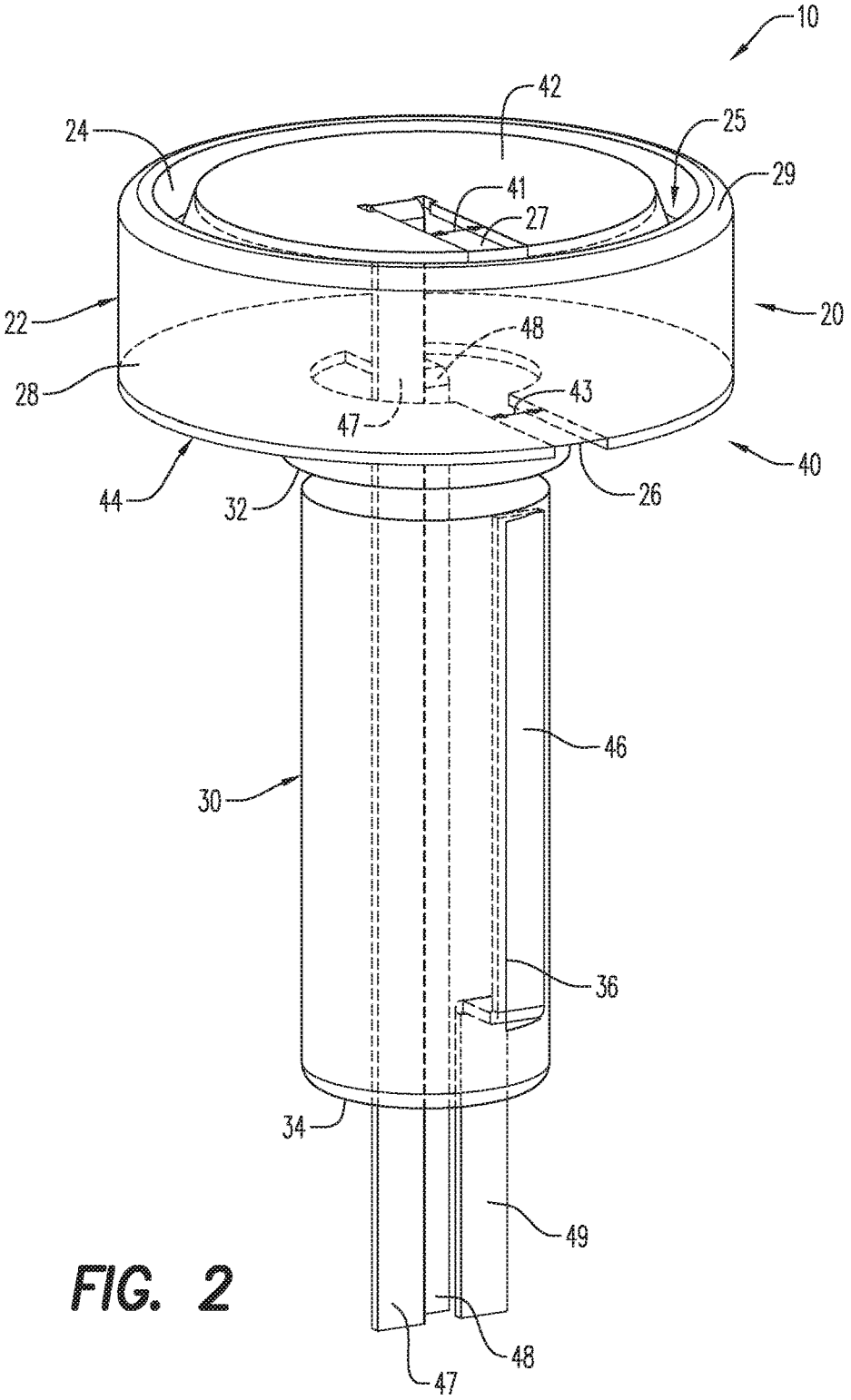
FIG. 2 is a perspective view of a initiator head assembly according to an aspect, showing the internal components in phantom.

Turning specifically to FIG. 2 and in an embodiment, the initiator head assembly 10 includes a body 20 and an electrical contact component 40. In an embodiment, the body 20 is formed as a unitary component as discussed in greater detail below. In an alternative embodiment found in FIGS. 5-9, the initiator head assembly 110 includes the body 120 and the electrical contact component 140, as described in more detail hereinbelow.

With reference again to FIG. 2 and in an embodiment, the body 20 includes a head 22 that extends from a base 30, and the entire body 20 is formed as a unitary member or component. Methods of forming the body 20 as a unitary member include but are not limited to injection molding and machining the component out of a solid block of material. In an embodiment, the injection molded body 20 is formed into a solid material, in which typically a thermoplastic material in a soft or pliable form is allowed to flow around the electrical contact component 140 during the injection molding process. The head 22 includes a first surface 24 and a second surface 26, and an insulating portion 28 extending between the first surface 24 and the second surface 26. With reference to FIG. 2 and in an embodiment, the first surface 24 of the head 22 includes a recessed or depressed area 25 positioned between a central portion 27 of the first surface 24 and the upper edge 29 of the insulating portion 28. Alternatively, the first surface 24 could be a solid, uniform surface (not shown).

The base 30 of the body 20 includes a first end 32 and a second end 34. In an embodiment, the first end 32 of the base 30 is formed integrally with the second surface 26 of the head 22. In an embodiment, an opening 36 extends along at least a portion of a side or outer surface of the base 30, and the opening 36 extends at least partially along a length of the base 30 between the first end 32 and the second end 34. In an alternative embodiment, it is possible to form the head 22 separately from the base 30, and to join the components together after formation through the use of adhesives, fasteners and the like.

The initiator head assembly 10 further includes an electrical contact component 40 that may be formed from an electrically conductive material, as would be understood by those of ordinary skill in the art. The electrical contact component 40 includes individual elements as discussed in greater detail below. In an embodiment, the electrical contact component 40 is also formed as a unitary member with electrical insulators positioned between the elements, while in another embodiment, the individual elements of the component 40 can be made separately and soldered or otherwise connected to form the elements of the component 40. The individual elements of the electrical contact component 40 can be formed of any electrically conductive material and using known methods such as wire forming, stamping, bending and the like.

Figure 3:
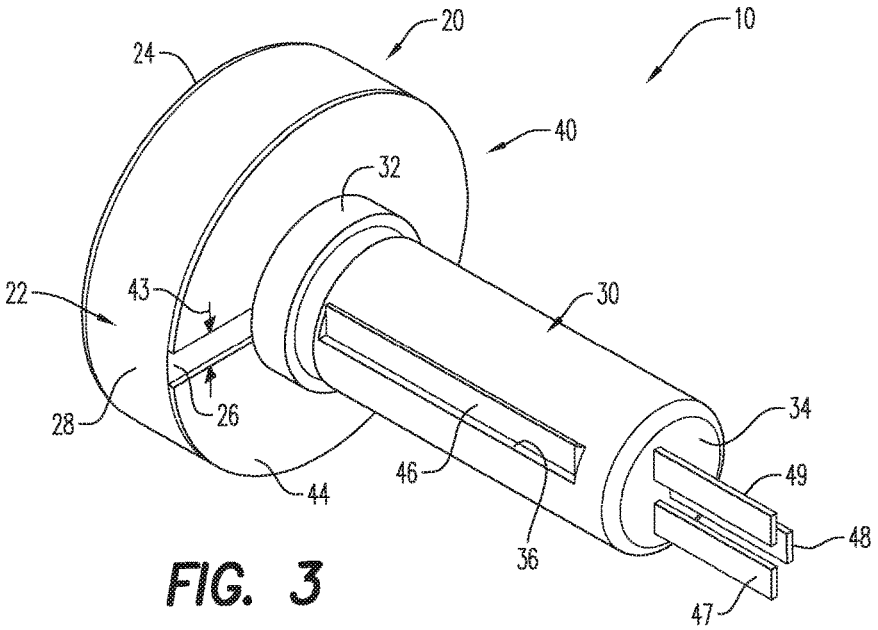
FIG. 3 is a perspective view of the initiator head assembly of FIG. 2 shown from a different angle.

With reference to FIGS. 2 and 3 and in an embodiment, the electrical contact component 40 includes multiple components, and as shown herein includes an electrically contactable line-in portion 42, an electrically contactable line-out portion 44, and an electrically contactable ground portion 46. As shown, a line-in wire 47 extends within an interior of the base 30, as does a line-out wire 48, and a ground wire 49. The line-in wire 47 extends from and connects to or is formed integrally with the line-in portion 42, the line-out wire 48 extends from and connects to or is formed integrally with the line-out portion 44, and the ground wire 49 extends from and connects to or is formed integrally with the ground portion 46. In an embodiment, the line-in wire 47, the line-out wire 48 and the ground wire 49 are arranged essentially parallel within the base 30 of the initiator head assembly 10. In yet a further embodiment, all of the elements forming the electrical contact component 40 are positioned in a way that the body 20 is formed as an integral and unitary component around the individual elements, and thus the body 20 forms the electrical insulation between the individual elements of the electrical contact component 40.

In an embodiment, the electrical contact component 40 is integrally formed with the body 20 such that the line-in portion 42 of the electrical contact component 40 is positioned proximal to the first surface 24 of the head 22 of the body 20 and the line-out portion 44 of the electrical contact component 40 is positioned proximal to the second surface 26, and the ground portion 46 of the electrical contact component 40 is positioned proximal to the opening 36 of the base 30 of the body 20. In an embodiment, the opening 36 is configured to allow at least a portion of the ground portion 46 to extend at least partially beyond an outer surface of the base 30. With reference to FIG. 2 and in an embodiment, the recessed or depressed area 25 of the first surface 24 of the body 20 extends around an outer periphery of the line-in portion 42, between the outer periphery of the line-in portion 42 and the upper edge 29 of the insulating portion 28. As shown, a top surface of the line-in portion 42 extends slightly beyond the upper edge 29, while it is possible that the top surface is below or coplanar with the upper edge 29 (not shown).

In an embodiment, the ground portion 46 in combination with the line-in portion 42 and the line-out portion 44 are configured to complete a wireless electrical connection by the electrical contact component 40 merely by contact, without using a wired electrical connection, when configured as depicted herein and positioned within the perforating gun assembly (not shown).

As depicted in FIG. 2 and in an embodiment, each of the line-in portion 42 and line-out portion 44 are formed of a flattened, semi-disc shaped electrically conductive material, for which gaps 41 and 43 respectively are present. The line-in gap 41 of line-in portion 42, and the line-out gap 43 of line-out portion 44, are configured to prevent the respective portions from sliding out of place during injection molding of the body 20. The gaps 41 and 43, respectively, thus serve as an anchor within the injection mold.

Figure 4:
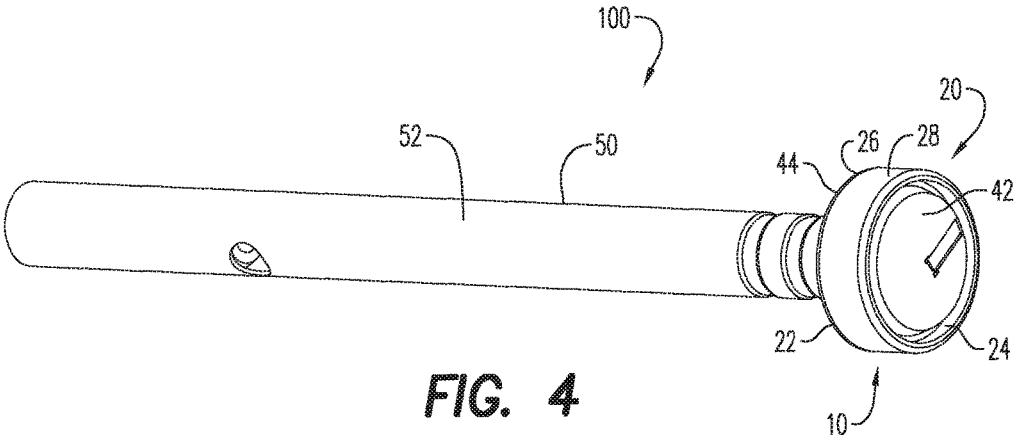
FIG. 4 is a perspective view of the initiator head assembly assembled with a shell to form an initiator for use with a perforating gun assembly according to an aspect.
Figure 5:
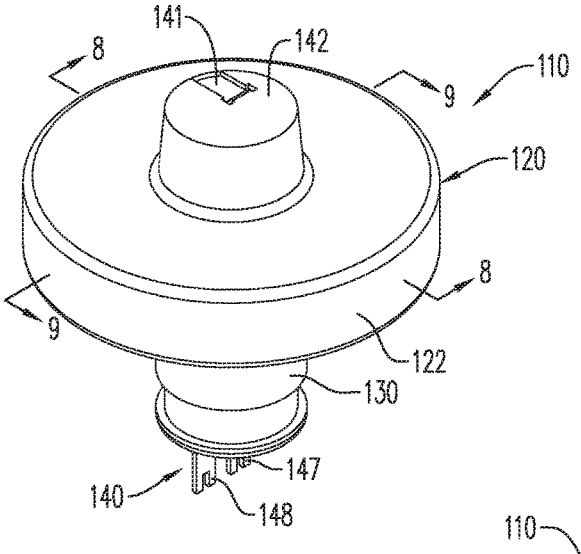
FIG. 5 is a perspective view of an alternative initiator head assembly according to an aspect.
Figure 6:
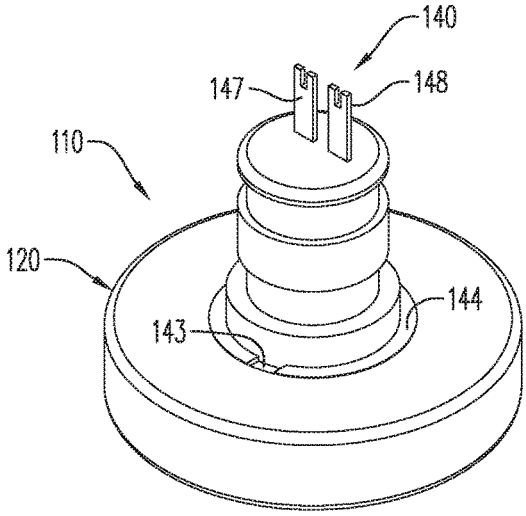
FIG. 6 is a perspective view of the initiator head assembly of FIG. 5 shown from a different angle.
Figure 7:
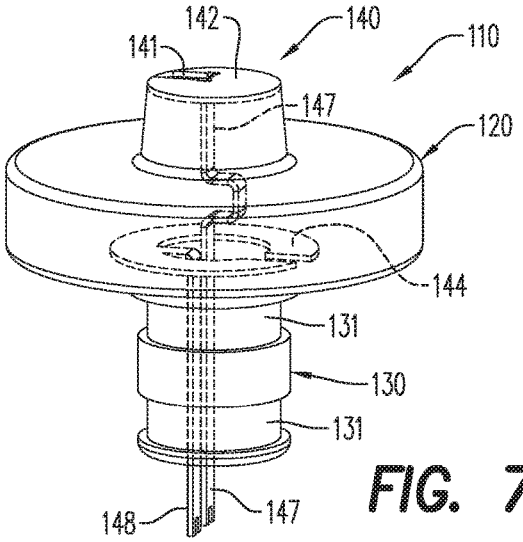
FIG. 7 is a perspective view of the initiator head assembly of FIG. 5 from a different angle showing a body in phantom.

In yet a further embodiment and as seen in FIG. 4, an initiator 100 is provided, in the form of a detonator. The initiator 100 is configured for being electrically contactably received within a perforating gun assembly without using the wired electrical connection as discussed above. The initiator 100 includes a shell or housing or casing 50, and at least a portion of the shell 50 includes an electrically conductive portion that is a ground portion 52. In an embodiment, the initiator 100 includes an initiator head assembly 10 that is a wirelessly-connectable and selective assembly. In assembled form, at least a portion of the base 30 of the body 20 is slidably arranged within one end of the shell 50, while the head 22 extends beyond the shell 50. Once the base 30 is positioned within the shell 50, the ground portion 46 of the electrical contact component 40, is positioned to effect the electrical contact with the ground portion 52 of the shell 50.

In an embodiment the ground portion 46 is flexible and extends through the opening 36 slightly beyond an external surface of the base 30. In this way, once the base 30 is seated or otherwise positioned within the shell 50, the ground portion 46 is placed in electrically contacting position with the ground portion 52 of the shell 50. That is, the electrical contact is made without using a wired electrical connection.

With reference to FIGS. 5-9 and in an alternative embodiment, the initiator head assembly 110 includes the body 120 and the electrical contact component 140. In this embodiment, the electrical contact component 140 includes the electrically contactable line-in portion 142 (FIG. 5) and the electrically contactable ground portion 144 (FIG. 6), whereby showing an alternative ground contact to the shell 150, as compared to including a separate ground portion 46 found in the embodiment described hereinabove (see, for instance, FIG. 3). As shown, the line-in wire 147 extends within the interior of the base 130, as does the ground wire 148. The line-in wire 147 extends from and connects to or is formed integrally with the line-in portion 142 and the ground wire 148 extends from and connects to or is formed integrally with the ground portion 144. In an embodiment, the line-in wire 147 and the ground wire 148 are arranged essentially parallel within the base 130 of the body 120. In yet a further embodiment, all of the elements forming the electrical contact component 140 are positioned in a way that the body 120 is formed as an integral and unitary component around the individual elements, and thus the body 120 forms the electrical insulation between the individual elements of the electrical contact component 140.

In this embodiment, the body 120 includes the head 122 that extends from the base 130, and the entire body 120 is formed as a unitary member or component. Methods of forming the body 120 as a unitary member are as set forth above.

Figure 8:
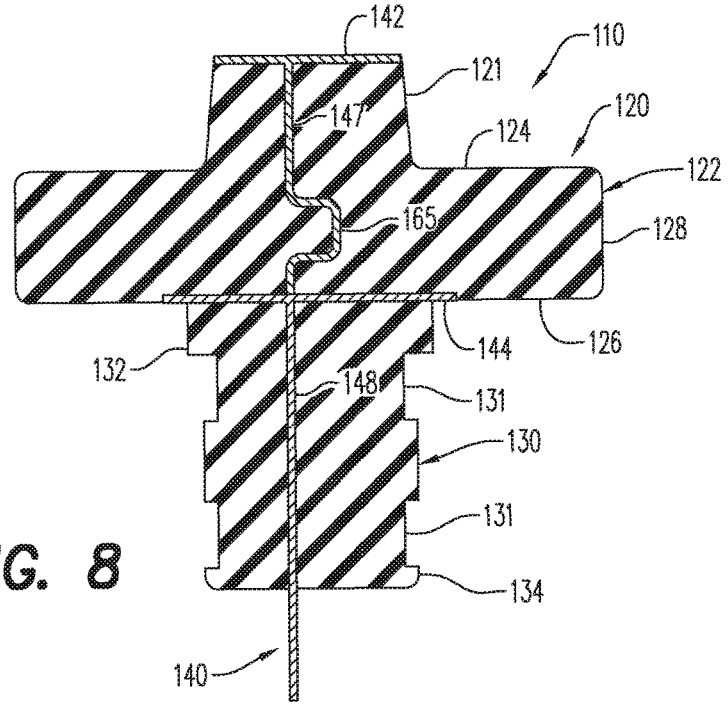
FIG. 8 is a schematic cross-sectional side view of the initiator head assembly taken along lines 8-8 of FIG. 5.

With reference particularly to FIGS. 8 and 9, the head 122 includes the first surface 124 and the second surface 126, and the insulating portion 128 extending between the first surface 124 and the second surface 126. In an embodiment, it is also possible to have a raised portion 121 extending from the first surface 124, which forms an elevated platform for receiving and positioning the line-in portion 142. This sort of arrangement may facilitate better positioning and electrical contactability. While not shown, it is also contemplated that the line-in portion 142 is positioned on the first surface 124 as described above with reference to FIGS. 2-4, and it is also possible for the embodiment depicted in FIGS. 2-4 to include a raised portion (not shown).

The base 130 of the body 120 includes a first end 132 and a second end 134. In an embodiment, the first end 132 of the base 130 is formed integrally with the second surface 126 of the head 122. In an alternative embodiment, it is possible to form the head 122 separately from the base 30, and to join the components together after formation through the use of adhesives, fasteners and the like. As depicted herein, the base 130 includes one or more (two shown) indentations or notched or recessed areas 131, which are configured for sealing the initiator head assembly 110 when positioned with an end of the shell 150 (see, for instance, FIGS. 10-11). As shown and in an embodiment, the indentation(s) 131 are configured to receive one or more head retaining member(s) 153 formed in the shell 150 to thus seal and hold in place the components. Thus, once the base 130 of the initiator head assembly 110 is positioned within the end of the shell 150, then the head retaining members 153 can be formed or pressed into the indentions 131 to form the seal. Alternatively, the indentation 131 could be configured to receive a sealing member, like an o-ring, such that when the base 130 is positioned within the end of the shell 150, a seal is made (not shown).

Figure 9A:
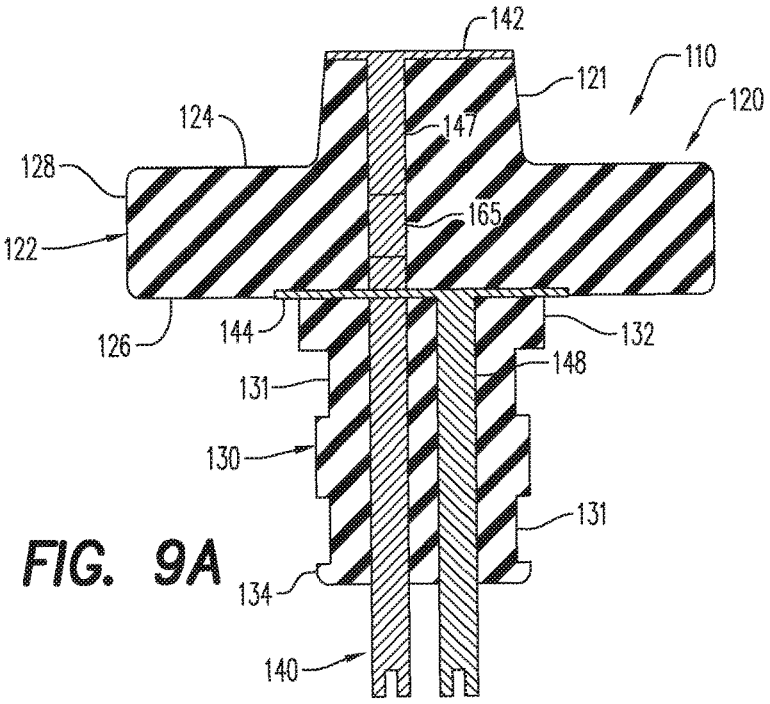
FIG. 9*a* is a schematic cross-sectional side view of the initiator head assembly taken along lines 9-9 of FIG. 5.
Figure 9B:
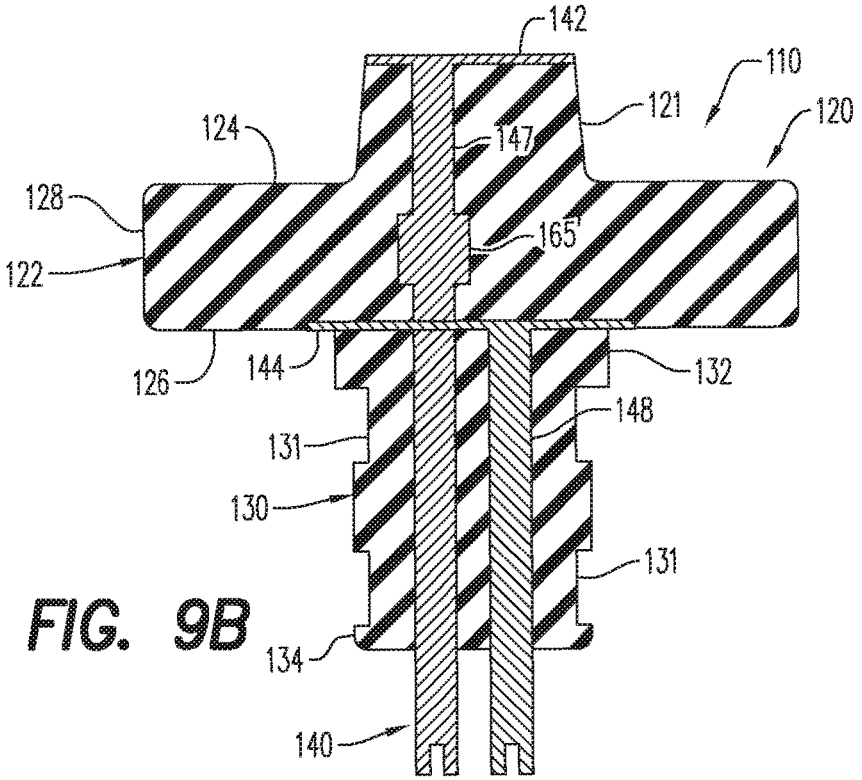
FIG. 9*b* is an alternative schematic cross-sectional side view of the initiator head assembly taken along lines 9-9 of FIG. 5.

With particular reference to FIGS. 8-9 and in an embodiment, a retaining member 165, depicted in FIG. 9*a* as a bend and in FIG. 9*b* as a flattened portion may be formed in the line-in wire 147, such that the retaining member 165 remains positioned within the body 120. In particular, the retaining member 165 is positioned somewhat centrally within the insulating portion 128 of the body 120. The retaining member 165 is thus configured and functions to further prevent the electrical contact component 140, or portions thereof, from sliding out of place during injection molding of the body 120 and when pressure differential is applied between or across surfaces 124 and 126. In this way, and as described above for gaps 41 (including gap 141) and 43 (including gap 143), the retaining member 165 thus serves as an anchor within the injection mold. In an embodiment, the retaining member 165 takes any shape sufficient to help hold the electrical contact component 140 in place during the injection molding process and when the pressure differential is seen between surfaces 124 and 126, and advantageously may be U-shaped or V-shaped if formed into a bend, and may be a straight member having a flattened portion or portion having a wider width than the wire itself.

Another way to describe the differential pressure experienced by the initiatory head assembly 110 found in FIGS. 5-11 is with reference to placement of the assembled initiator, when placed within, for instance, a perforating gun assembly. In short the initiator head assembly 110 must be capable of maintaining the pressure differential that may be experienced, for instance, upon detonation. Although it is difficult to represent figuratively, FIG. 10 attempts to show that the initiator head assembly 110 has an ability to hold a pressure differential between an outer surface 154 of the initiatory head assembly 110, (i.e. the surface positioned upstream of the detonation) and an inner surface 155 of the initiatory head assembly 110, (i.e. the surface positioned downstream—or near the detonation), and thus avoid pressure leakage through the wires or electrical connections. By forming the initiator head assembly 110 as a unitary member, in an embodiment through injection molding the body 120 around the electrical contact component 140, such points of pressure leakage can be eliminated. In particular, it is believed that providing the line-in gap 141 in the line-in portion 142 and/or the gap 143 in the ground portion 144 and/or providing the retaining member 165 in the line-in wire 147, provides opportunity for molten material during the injection molding to flow around and thus secure the electrical contact component 140 in place upon solidification. In other words, the initiator head assembly 110 thus formed is essentially self-sealing.

Figure 1:
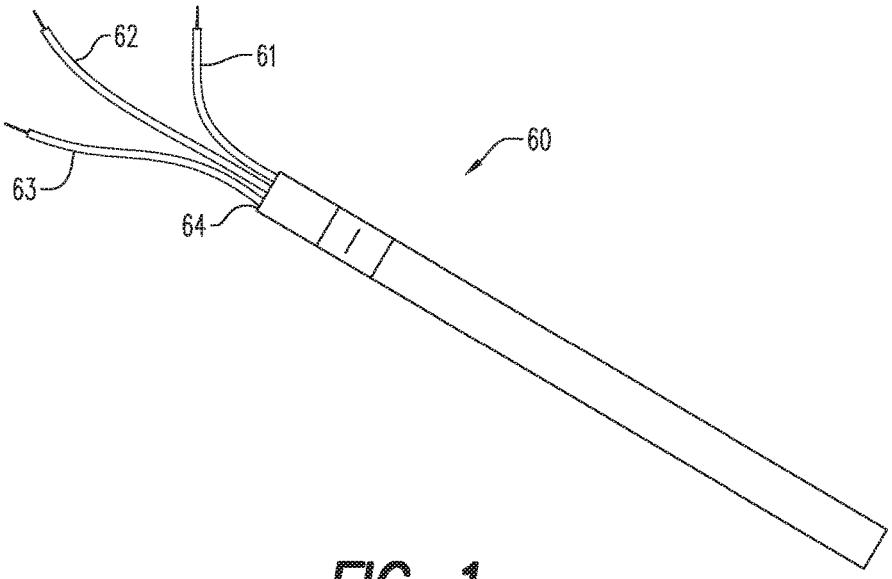
FIG. 1 (PRIOR ART)
FIG. 1 is a perspective view of a wired detonator according to the prior art.

In an embodiment, the body 120 is injection molded and configured as a sealed unit to maintain the differential pressure between the outer surface 154 and the inner surface 155. Turning again to FIG. 1, the wires 61, 62 and 63 pass directly through an upper surface 64 of the detonator 60, while using o-rings or other sealing means to try to seal the individual openings through which the wires pass. Thus, maintaining a pressure differential is difficult at best in the initiator assemblies that are currently available. Providing the initiator head assembly 110 as described herein cures the defects of the prior art.

In an embodiment, a method of making an initiator head assembly 10,110 includes the steps of forming the electrical contact component 40, 140 and the body 20, 120. As contemplated and as discussed above, it is possible to form the body 20, 120 as a unitary component around the electrical contact component 40, 140. In an embodiment, the method of making the initiator head assembly 10, 110, includes embedding the electrical contact component 40, 140 within the body 20, 120, and in particular embedding the electrical contact component 40, 140 within the body 20 during formation of the body 20.

In an embodiment, the initiator 100, 200 including the initiator head assembly 10, 110 described in detail herein is configured for being electrically contactably received within a perforating gun assembly without using a wired electrical connection.

In an embodiment, the line-in portion 42, 142, and the line-out portion 44, with or without the ground portion 46, 144 are configured to replace the wired connection of the prior art wired detonator 60 and to complete the electrical connection merely by contact with other electrical contacting components. In this way, the line-in portion 42, 142 of the assembly 10, 110 replaces the signal-in wire 61 of the wired detonator 60, and the line-out portion 44, replaces the signal-out wire 62 and the ground portion 46, 144 replaces the ground wire 63. Thus, when placed within the perforating gun assembly, the line-in portion 42, 142, and the line-out portion 44, with or without the ground portion 46, 144 make an electrical connection by merely making contact with corresponding electrical contacting components provided within the gun assembly. That is, the initiator head assembly 10, 110 is wirelessly connectable only by making and maintaining electrical contact of the electrical contacting components to replace the wired electrical connection and without using a wired electrical connection.

In an embodiment, the initiator 100, 200 is configured to wirelessly and selectively receive an ignition signal, (typically a digital code uniquely configured for a specific detonator), to fire the perforating gun assembly. By "selective" what is meant is that the initiator is configured to receive one or more specific digital sequence(s), which differs from a digital sequence that might be used to arm and/or detonate another initiator in a different, adjacent perforating gun assembly, for instance, a train of perforating gun assemblies. So, detonation of the various assemblies does not necessarily have to occur in a specified sequence. Any specific assembly can be selectively detonated. In an embodiment, the detonation occurs in a top-down or bottom-up sequence.

In an embodiment, the initiator 100, 200 may be fluid disabled. "Fluid disabled" means that if the perforating gun has a leak and fluid enters the gun system then the detonator is disabled by the presence of the fluid and hence the explosive train is interrupted. This prevents a perforating gun from splitting open inside a well if it has a leak and plugging the wellbore, as the hardware would burst open. In an embodiment, the initiator 100, 200 is a selective fluid disabled electronic (SFDE) assembly.

The initiator 100, 200 according to an aspect can be either an electric or an electronic detonator. In an electric detonator, a direct wire from the surface is electrically contactingly connected to a detonator assembly and power is increased to directly initiate a fuse head. In an electronic detonator assembly, circuitry of an electronic circuit board within the detonator assembly is used to initiate the fuse head.

In an embodiment, the initiator 100, 200 may be immune to stray current or voltage and/or radiofrequency (RF) signals or induced currents to avoid inadvertent firing of the perforating gun or setting tool or any other downhole tool. Thus, in this embodiment, the initiator 100, 200 is provided with means for ensuring immunity to stray current or voltage and/or RF signals, such that the initiator 100, 200 is not initiated through random radio frequency signals, stray voltage or stray current. In other words, the initiator 100, 200 is configured to avoid unintended initiation.

The components and methods illustrated are not limited to the specific embodiments described herein, but rather, features illustrated or described as part of one embodiment can be used on or in conjunction with other embodiments to yield yet a further embodiment. Such modifications and variations are intended to be included. Further, steps described in the method may be utilized independently and separately from other steps described herein.

While the apparatus and method have been described with reference to various embodiments, it will be understood by those skilled in the art that various changes may be made and equivalents may be substituted for elements thereof without departing from the scope. In addition, many modifications may be made to adapt a particular situation or material to the teachings without departing from the essential scope thereof. In the interest of brevity and clarity, and without the need to repeat all such features, it will be understood that any feature relating to one embodiment described herein in detail, may also be present in an alternative embodiment. As an example, it would be understood by one of ordinary skill in the art that if the electrical contact component 40 of one embodiment is described as being formed of an electrically conductive material, that the electrical contact component 140 described in the alternative embodiment is also formed of an electrically conductive material, without the need to repeat all such features.

In this specification and the claims that follow, reference will be made to a number of terms that have the following meanings. The singular forms "a," "an" and "the" include plural referents unless the context clearly dictates otherwise. Furthermore, references to "one embodiment" are not intended to be interpreted as excluding the existence of additional embodiments that also incorporate the recited features. Terms such as "first," "second," etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of."

Advances in science and technology may make equivalents and substitutions possible that are not now contemplated by reason of the imprecision of language; these variations should be covered by the appended claims. This written description uses examples, including the best mode, and also to enable any person of ordinary skill in the art to practice, including making and using any devices or systems and performing any incorporated methods. The patentable scope is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. An initiator head assembly, comprising:

a body comprising a head extending from a base, the head including a first surface, a second surface, and an insulating portion extending therebetween, and the base including a first end and a second end, wherein the body is composed of a thermoplastic material and the first end of the base extends from the second surface of the head; and an electrical contact component comprising an electrically contactable line-in portion and an electrically contactable ground portion, wherein the electrical contact component is positioned proximal to the body, wherein the electrically contactable line-in portion is positioned proximal to the first surface, and the ground portion is positioned proximal to the second surface.

2. The initiator head assembly of claim 1, wherein the electrical contact component extends through the body and is embedded within the body.

3. The initiator head assembly of claim 1, wherein the body is formed as an integral and unitary component around the electrical contact component.

4. The initiator head assembly of claim 1, wherein the first surface of the head includes a recessed area, wherein the recessed area extends around an outer periphery of the line-in portion, and is positioned between a central portion of the first surface and an upper edge of the insulating portion.

5. The initiator head assembly of claim 4, wherein the recessed area of the first surface of the body extends between the outer periphery of the line-in portion and the upper edge of the insulating portion.

6. The initiator head assembly of claim 1, wherein the electrical contact component further comprises an electrically contactable line-out portion.

7. The initiator head assembly of claim 6, further comprising:

a line-in wire extending from the line-in portion;

a line-out wire extending from the line-out portion; and a ground wire extending from the ground portion, wherein each wire extends within an interior of the base, and the ground portion in combination with the line-in portion and the line-out portion complete a wireless electrical connection by the electrical contact component merely by contact, without using a wired electrical connection.

8. The initiator head assembly of claim 7, wherein the body is formed as an integral and unitary component around the line-in portion, the line-out portion, and the ground portion, such that the body forms the electrical insulation between the line-in portion, the line-out portion, and the ground portion.

9. The initiator head assembly of claim 7, wherein at least one of the line-in portion and line-out portion is formed of a flattened, semi-disc shaped electrically conductive material.

10. An initiator configured for being electrically contactably received within a perforating gun assembly without using a wired electrical connection, comprising:

a shell comprising a ground portion; and a wirelessly-connectable selective initiator head assembly, comprising a body including a head extending from a base, the head including a first surface, a second surface, and an insulating portion extending therebetween, and the base including a first end and a second end, wherein the body is composed of a thermoplastic material and the first end of the base extends from the second surface of the head, and an electrical contact component comprising an electrically contactable line-in portion and an electrically contactable ground portion, the electrical contact component being positioned proximal to the body, wherein the base is positioned in the shell.

11. The initiator of claim 10, wherein the body is injection molded to form a sealed unit around the electrical contact component to seal the electrical contact component against pressure leakage across the body.

12. The initiator of claim 10, wherein the electrical contact component is positioned proximal to the first surface, and the ground portion of the electrical contact component is positioned proximal to the second surface.

13. The initiator of claim 10, wherein the electrical contact component further comprises an electrically contactable line-out portion.

14. The initiator of claim 13, further comprising:

a line-in wire extending from the electrically contactable line-in portion;

a line-out wire extending from the electrically contactable line-out portion; and a ground wire extending from the electrically contactable ground portion, wherein each wire extends within an interior of the base, and the electrically contactable ground portion, in combination with the electrically contactable line-in portion and the electrically contactable line-out portion, are configured to complete a wireless electrical connection merely by contact, without using a wired electrical connection.

15. An initiator head assembly, comprising:

a body comprising a head extending from a base, the head including a first surface, a second surface, and an insulating portion extending therebetween, and the base including a first end and a second end, wherein the body is composed of a thermoplastic material and the first end of the base extends from the second surface of the head; and an electrical contact component positioned proximal to the body, the electrical contact component comprising an electrically contactable line-in portion, an electrically contactable ground portion, an electrically contactable line-out portion and an electrical insulation between the line-in portion, the ground portion and the line-out portion.

16. The initiator head assembly of claim 15, further comprising:

a line-in wire extending from the line-in portion;

a line-out wire extending from the line-out portion; and a ground wire extending from the ground portion, wherein each wire extends within an interior of the base, and the ground portion in combination with the line-in portion and the line-out portion complete a wireless electrical connection by the electrical contact component merely by contact, without using a wired electrical connection.

17. The initiator head assembly of claim 16, wherein the body is formed as an integral and unitary component around the line-in portion, the line-out portion, and the ground portion, such that the body forms the electrical insulation between the line-in portion, the line-out portion, and the ground portion.

18. The initiator head assembly of claim 15, wherein the first surface of the head includes a recessed area, wherein the recessed area extends around an outer periphery of the line-in portion, and is positioned between a central portion of the first surface and an upper edge of the insulating portion.

19. The initiator head assembly of claim 18, wherein the recessed area of the first surface of the body extends between the outer periphery of the line-in portion and the upper edge of the insulating portion.

* * * * *